US009082346B2

(12) United States Patent
Shih

(10) Patent No.: US 9,082,346 B2
(45) Date of Patent: Jul. 14, 2015

(54) LIGHT EMITTING DIODE CIRCUITRY, METHOD FOR DRIVING LIGHT EMITTING DIODE CIRCUITRY AND DISPLAY

(71) Applicant: AU Optronics Corp., Hsin-Chu (TW)

(72) Inventor: Li-Wei Shih, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 393 days.

(21) Appl. No.: 13/665,940

(22) Filed: Nov. 1, 2012

(65) Prior Publication Data

US 2013/0169170 A1 Jul. 4, 2013

(30) Foreign Application Priority Data

Dec. 30, 2011 (TW) ..... 100149952 A

(51) Int. Cl.

| | |
|---|---|
| ***H05B 39/00*** | (2006.01) |
| ***H05B 37/00*** | (2006.01) |
| ***G09G 3/32*** | (2006.01) |
| ***H05B 33/08*** | (2006.01) |

(52) U.S. Cl.

CPC ..... *G09G 3/3233* (2013.01); *H05B 33/0815* (2013.01); *G09G 2320/045* (2013.01)

(58) Field of Classification Search

CPC ..... G09G 2310/061; G09G 2320/0223; G09G 2320/0252; G09G 2320/029; G09G 2320/045; G09G 3/006; G09G 3/20; G09G 3/2022; G09G 3/3225; G09G 3/3688; G09G 2300/0408; G09G 2300/0426; G09G 2300/0439

See application file for complete search history.

(56) References Cited

U.S. PATENT DOCUMENTS

| | | | | |
|---|---|---|---|---|
| 7,800,556 | B2 | 9/2010 | Chen | |
| 2005/0122289 | A1* | 6/2005 | Yamazaki et al. | 345/77 |
| 2011/0115835 | A1 | 5/2011 | Lee | |
| 2011/0141000 | A1 | 6/2011 | Han | |

FOREIGN PATENT DOCUMENTS

| | | |
|---|---|---|
| CN | 101866619 A | 10/2010 |
| TW | 200735019 | 9/2007 |

* cited by examiner

*Primary Examiner* — Douglas W Owens
*Assistant Examiner* — Monica C King
(74) *Attorney, Agent, or Firm* — Winston Hsu; Scott Margo

(57) ABSTRACT

A light emitting diode circuitry includes a first transistor, a second transistor, a third transistor, a fourth transistor, a storage capacitor, a fifth transistor, a sixth transistor and light emitting diodes. The first transistor is used for receiving a first control signal. The second transistor is used for receiving a second control signal. The third transistor is electrically coupled to the second transistor and the first transistor. The fourth transistor is used for receiving a data signal and a third control signal. The storage capacitor is electrically coupled to the second transistor. The fifth transistor is used for receiving a fourth control signal. The sixth transistor is used for receiving a fifth control signal. The light emitting diodes are coupled to the sixth transistor and a power source.

20 Claims, 5 Drawing Sheets

LIGHT EMITTING DIODE CIRCUITRY, METHOD FOR DRIVING LIGHT EMITTING DIODE CIRCUITRY AND DISPLAY

BACKGROUND

1. Technical Field

The present invention relates to a light emitting diode circuitry, especially to a light emitting diode circuitry applied to light emitting diode displays.

2. Description of the Prior Art

Liquid crystal displays (LCDs) and light emitting diode (LED) displays are widely used nowadays. Because liquid crystal displays and LED displays have slim shapes, low power dissipation and low radiation, liquid crystal displays and LED displays gradually replace traditional CRT (cathode ray tube) monitors and are widely used in mobile electronic devices such as notebooks and PDAs (personal digital assistants).

Compared to LCDs, organic light emitting diode (OLED) displays are capable of self-emitting light and have wider viewing angle, higher contrast, lower operating voltage, faster dynamic response, brighter color, simpler manufacturing process and thinner thickness, thus they are gradually replacing LCDs. In OLED display manufacturing procedures, a bias voltage is applied to an OLED, to make the inner electrons and electric holes pass through the hole transport layer and the electron transport layer, then add an organic material having light emitting characteristic into the OLED. The organic material will combine with the OLED to form an exciton to release energy. After energy is released, the exciton returns to the ground state. The energy can be released in various colored light, and the color is determined by the characteristic of chosen materials. However, comparing with liquid crystal displays and LED displays, the service life of OLED displays are still relatively short.

Please refer to FIG. 1, FIG. 1 shows a related art LED circuitry 100. As shown in FIG. 1, the LED circuitry 100 includes a first transistor M1, a second transistor M2, a storage capacitor Cst and an LED D1. The first end of the first transistor M1 is electrically coupled to a data line DATA, and the control end of the first transistor M1 is electrically coupled to a scan line SCAN. The first end of the second transistor M2 is electrically coupled to a first power source VDD, and the control end of the second transistor M2 is electrically coupled to a second end of the first transistor M1. The first end of the capacitor Cst is electrically coupled to the first power source VDD, and the second end of the capacitor Cst is electrically coupled to the second end of the first transistor M1. The anode of the light emitting diode D1 is electrically coupled to the second end of the second transistor M2, and the cathode of the light emitting diode D1 is electrically coupled to a second power source VSS. The voltage level of the first power source VDD is high, and the voltage level of the second power source VSS is low. When the first transistor M1 is turned on by the scan line SCAN, the first transistor M1 will receive signals from the data line DATA and store voltage into the storage capacitor Cst, after that, the first transistor M1 controls the second transistor M2 according to the received signals to make the light emitting diode D1 emit light. However, under this configuration, the voltage level of the cathode of the light emitting diode D1 will gradually become higher, causing the current following from the first power source VDD through the light emitting diode D1 become smaller, thus deteriorating the image retention effect of displays. Further, if replacing the light emitting diode D1 with an OLED, the total service life of the light emitting diode circuit 100 will be greatly reduced.

SUMMARY

An embodiment of the present invention relates to a light emitting diode circuitry. The light emitting diode circuitry includes a first transistor, a second transistor, a third transistor, a fourth transistor, a storage capacitor, a fifth transistor, a sixth transistor and a light emitting diode. The first transistor has a control end for receiving a first control signal, a first end for electrically coupling to a first power source, and a second end. The second transistor has a control end for receiving a second control signal, a first end electrically coupled to the second end of the first transistor, and a second end. The third transistor has a control end electrically coupled to the second end of the second transistor, a first end electrically coupled to the second end of the first transistor, and a second end. The fourth transistor has a first end for receiving a data signal, a control end for receiving a third control signal, and a second end electrically coupled to the second end of the third transistor. The storage capacitor has a first end electrically coupled to the second end of the second transistor, and a second end. The fifth transistor has a first end electrically coupled to the second end of the storage capacitor, and a control end for receiving a fourth control signal, and a second end for electrically coupling to a reference voltage source. The sixth transistor has a first end electrically coupled to the second end of the fourth transistor, a control end for receiving a fifth control signal, and a second end electrically coupled to the second end of the storage capacitor. The light emitting diode has a first end electrically coupled to the second end of the sixth transistor, and a second end for electrically coupling to a second power source.

Another embodiment of the present invention relates to a light emitting diode circuitry. The light emitting diode circuitry includes a first control signal trace, a second control signal trace, a third control signal trace, a fourth control signal trace, a fifth control signal trace, a first power trace, a second power trace, a reference voltage source trace, a data signal trace, a first transistor, a second transistor, a third transistor, a fourth transistor, a storage capacitor, a fifth transistor, a sixth transistor and a light emitting diode. The first transistor has a control end electrically coupled to the first control signal trace, a first end for electrically coupling to the first power trace, and a second end. The second transistor has a control end electrically coupled to the second control signal trace, a first end electrically coupled to the second end of the first transistor, and a second end. The third transistor has a control end electrically coupled to the second end of the second transistor, a first end electrically coupled to the second end of the first transistor, and a second end. The fourth transistor has a first end electrically coupled to the data signal trace, a control end electrically coupled to the third control signal trace, and a second end electrically coupled to the second end of the third transistor. The storage capacitor has a first end electrically coupled to the second end of the second transistor, and a second end. The fifth transistor has a first end electrically coupled to the second end of the storage capacitor, and a control end electrically coupled to the fourth control signal trace, and a second end for electrically coupling to the reference voltage source trace. The sixth transistor has a first end electrically coupled to the second end of the fourth transistor, a control end electrically coupled to the fifth control signal trace, and a second end electrically coupled to the second end of the storage capacitor. The light emitting diode has a first end electrically coupled to the second end of the sixth transistor, and a second end for electrically coupling to the second power trace.

Another embodiment of the present invention relates to a method for driving a light emitting diode circuitry. The light emitting diode circuitry includes a first transistor, a second transistor, a third transistor, a fourth transistor, a fifth transistor, a sixth transistor, a storage capacitor, and a light emitting diode. A first end of the first transistor is coupled to a first power source, and a second end of the first transistor is electrically coupled to a first end of the second transistor and a first end of the third transistor. A second end of the second transistor is electrically coupled to a first end of the storage capacitor and a control end of the third transistor. A first end of the fourth transistor is electrically coupled to a data source. A second end of the third transistor is electrically coupled to a second end of the fourth transistor and a first end of the sixth transistor. A second end of the storage capacitor is electrically coupled to a second end of the sixth transistor and a first end of the fifth transistor. A second end of the fifth transistor is electrically coupled to a reference voltage source. The light emitting diode is electrically coupled to the second end of the sixth transistor and a second power source. The method includes turning off the sixth transistor and turning on the second and fifth transistors when the first transistor is turned on and the fourth transistor is turned off to refresh the storage capacitor, turning off the first transistor and turning on the fourth transistor after refreshing the storage capacitor to write a data signal inputted by the data source to the storage capacitor, and turning on the first and sixth transistors and turning off the second, fourth and fifth transistors after writing the data signal to the storage capacitor to turn on the light emitting diode according to the data signal.

Another embodiment of the present invention relates to a display. The display includes a power supply, a reference voltage source generating unit, a scan driver, a data driver, a timing controller and a plurality of light emitting diode circuitries. The power supply is used for providing a first power source and a second power source. The reference voltage source generating unit is used for providing a reference voltage source. The scan driver is used for providing a first control signal, a second control signal, a third control signal, a fourth control signal and a fifth control signal. The data driver is used for providing a data signal. The timing controller is electrically coupled to the scan driver and the data driver for controlling the scan driver and the data driver. The plurality of light emitting diode circuitries are electrically coupled to the power supply, the reference voltage generating unit, the scan driver and the data driver. Each light emitting diode circuitry includes a first transistor, a second transistor, a third transistor, a fourth transistor, a storage capacitor, a fifth transistor, a sixth transistor and a light emitting diode. The first transistor has a control end for receiving a first control signal, a first end for electrically coupling to a first power source, and a second end. The second transistor has a control end for receiving a second control signal, a first end electrically coupled to the second end of the first transistor, and a second end. The third transistor has a control end electrically coupled to the second end of the second transistor, a first end electrically coupled to the second end of the first transistor, and a second end. The fourth transistor has a first end for receiving a data signal, a control end for receiving a third control signal, and a second end electrically coupled to the second end of the third transistor. The storage capacitor has a first end electrically coupled to the second end of the second transistor, and a second end. The fifth transistor has a first end electrically coupled to the second end of the storage capacitor, and a control end for receiving a fourth control signal, and a second end for electrically coupling to a reference voltage source. The sixth transistor has a first end electrically coupled to the second end of the fourth transistor, a control end for receiving a fifth control signal, and a second end electrically coupled to the second end of the storage capacitor. The light emitting diode has a first end electrically coupled to the second end of the sixth transistor, and a second end for electrically coupling to a second power source. The light emitting diode is turned on according to a voltage of the second end of the sixth transistor.

These and other objectives of the present invention will no doubt become obvious to those of ordinary skill in the art after reading the following detailed description of the preferred embodiment that is illustrated in the various figures and drawings.

DETAILED DESCRIPTION

Some phrases are referred to specific elements in the present specification and claims, please notice that the manufacturer might use different terms to refer to the same elements. However, the definition between elements is based on their functions instead of their names. Further, in the present specification and claims, the term "comprising" is open type and should not be viewed as the term "consisted of." Besides, the term "electrically coupled" can be referred to either directly connecting or indirectly connecting between elements.

The embodiments and figures are provided as follows in order to illustrate the present invention in detail, but please notice that the claimed scope of the present invention is not limited by the provided embodiments and figures.

Figure 1:
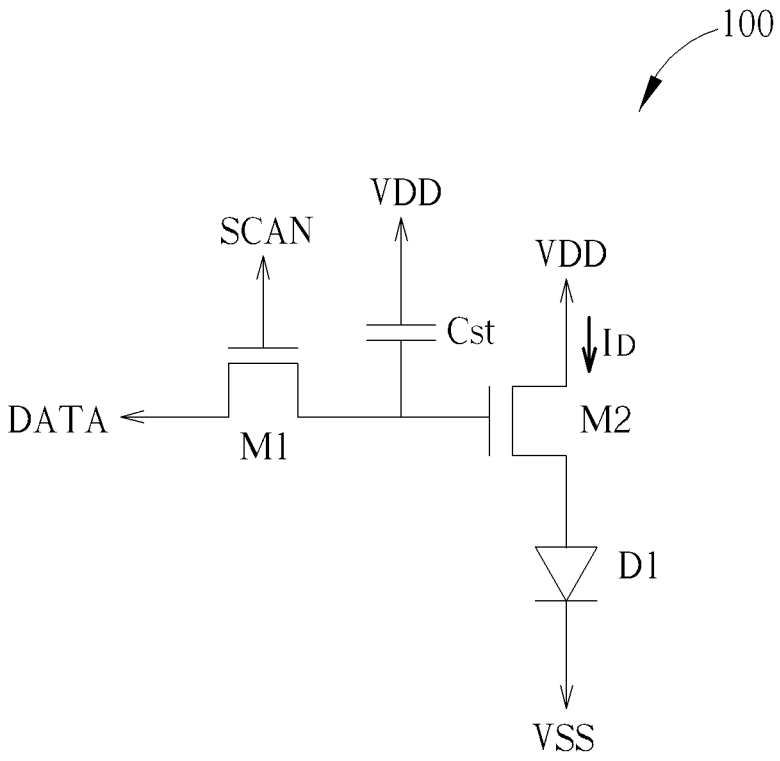
FIG. 1 PRIOR ART
FIG. 1 shows a related art LED circuitry.
Figure 2:
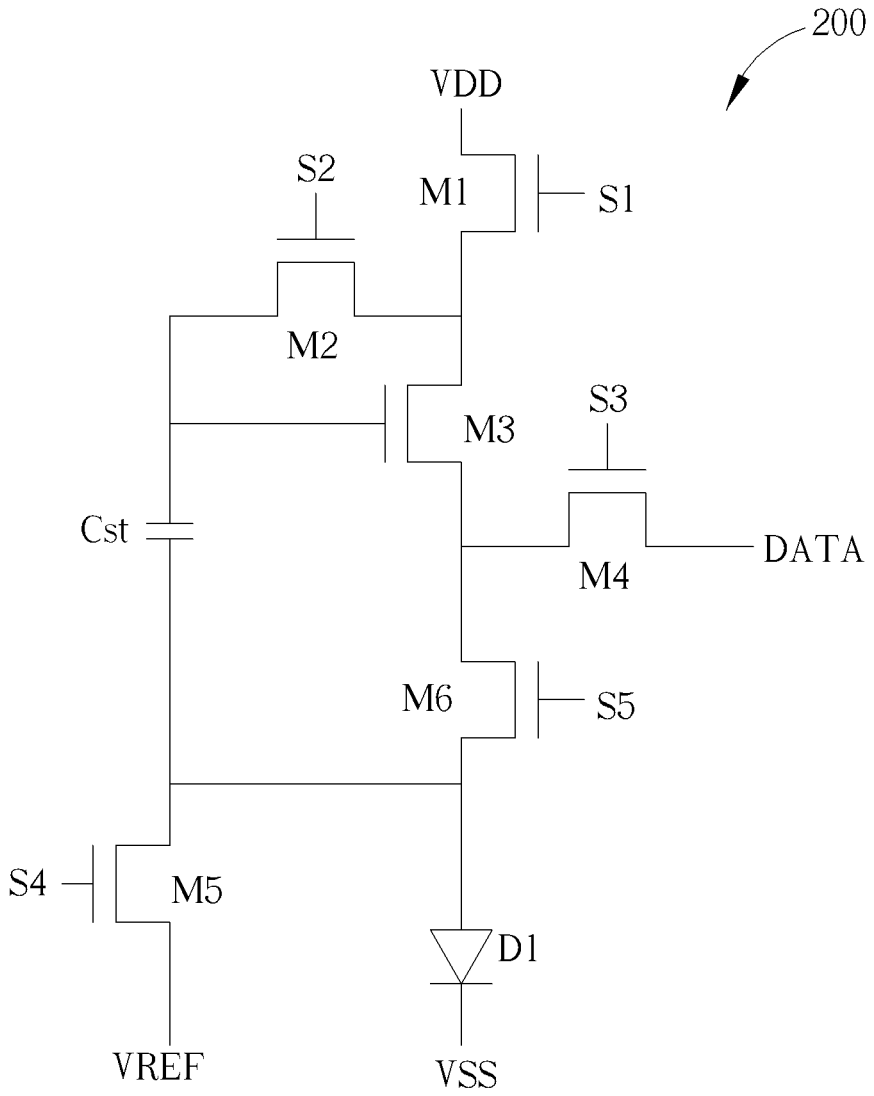
FIG. 2 shows an LED circuitry according to the first embodiment of the present invention.

Please refer to FIG. 2. FIG. 2 shows an LED circuitry 200 according to the first embodiment of the present invention. The LED circuitry 200 comprises a first transistor M1, a second transistor M2, a third transistor M3, a fourth transistor M4, a storage capacitor Cst, a fifth transistor M5, a sixth transistor ME and a light emitting diode D1. The first transistor M1 has a control end for receiving a first control signal S1, a first end for electrically coupling to a first power source VDD, and a second end. The second transistor M2 has a control end for receiving a second control signal S2, a first end electrically coupled to the second end of the first transistor M1, and a second end. The third transistor M3 has a control end electrically coupled to the second end of the second transistor M2, a first end electrically coupled to the second end of the first transistor M1, and a second end. The fourth transistor M4 has a first end for receiving a data signal DATA from a data source, a control end for receiving a third control signal S3, and a second end electrically coupled to the second end of the third transistor M3. The storage capacitor Cst has a first end electrically coupled to the second end of the second transistor M2, and a second end. The fifth transistor M5 has a first end electrically coupled to the second end of the storage capacitor Cst, a control end for receiving a fourth control signal S4, and a second end for electrically coupling to a reference voltage source VREF. The sixth transistor M6 has a first end electrically coupled to the second end of the fourth transistor M4, a control end for receiving a fifth control signal S5, and a second end electrically coupled to the second end of the storage capacitor Cst. The light emitting diode D1 has a first end electrically coupled to the second end of the sixth transistor M6, and a second end for electrically coupling to a second power source VSS. The first end of the light emitting diode D1 is an anode, and the second end of the light emitting diode D1 is a cathode. The light emitting diode D1 is used to emit light according to the voltage level of the second end of the sixth transistor M6. In the first embodiment, the first transistor M1, the second transistor M2, the third transistor M3, the fourth transistor M4, the fifth transistor M5 and the sixth transistor M6 can be N type metal oxide semiconductor transistor. However, the type of the first transistor M1, the second transistor M2, the third transistor M3, the fourth transistor M4, the fifth transistor M5 and the sixth transistor M6 is not limited, and can also be other types of transistors, e.g. field effect transistor, thin film transistor, bipolar junction transistor or thin film field effect transistor. The light emitting diode D1 can be an OLED. Besides, the voltage level of the first power source VDD is high, and the voltage level of the second power source VSS is low.

Figure 3:
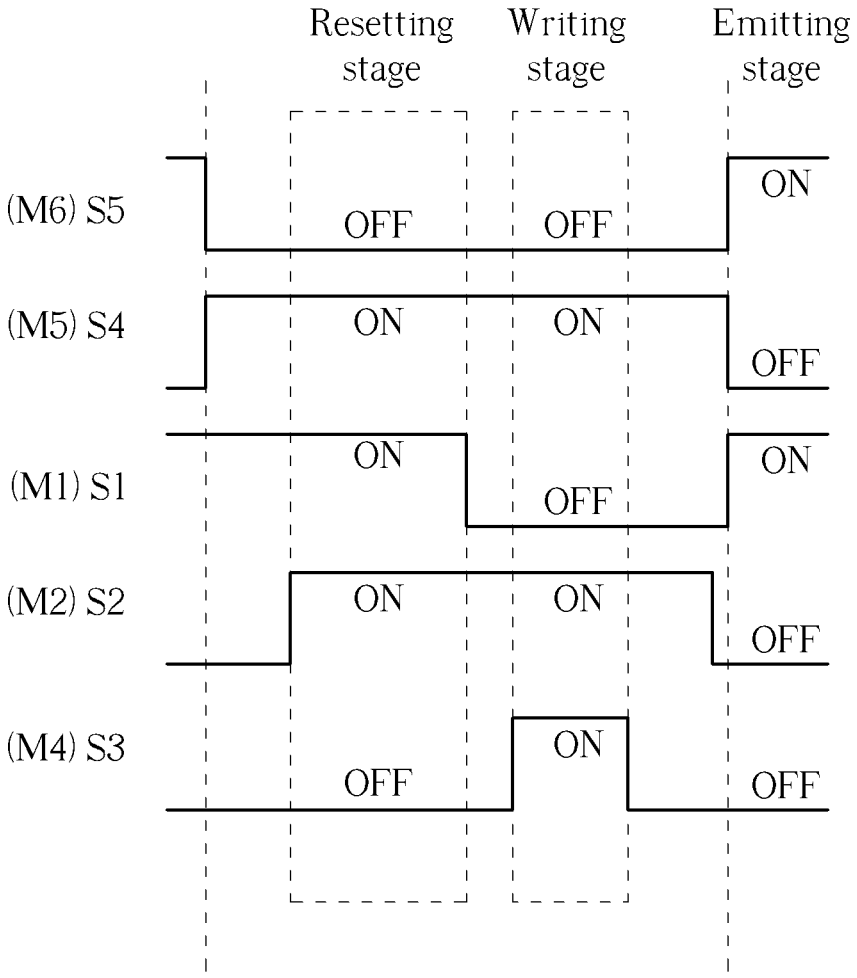
FIG. 3 shows the timing for operating the LED circuitry of FIG. 2.

Please refer to FIGS. 2 and 3. FIG. 3 shows the timing for operating the LED circuitry of FIG. 2. As depicted in FIG. 3, during the reset stage, when the first transistor M1 is turned on by the first control signal S1 and the fourth transistor M4 is turned off by the third control signals S3, the fifth control signal S5 will turn off the sixth transistor M6, the second control signal S2 will turn on the second transistor M2 and the fourth control signal S4 will turn on the fifth transistor M5 to reset the storage capacitor Cst. Thus, the first end of the storage capacitor Cst will be reset according to the voltage level of the first voltage source VDD, and the second end of the storage capacitor Cst will be reset according to the voltage level of the reference voltage source VREF. After resetting the storage capacitor Cst, perform the write stage. During the write stage, the first control signal S1 will turn off the first transistor M1, and the third control signal S3 will turn on the fourth transistor M4 to write the data signal DATA inputted from the data source to the storage capacitor Cst. More explicitly, the first end of the storage capacitor Cst will discharge via the second transistor M2, the third transistor M3 and the fourth transistor M4, so that the voltage of the first end of the storage capacitor Cst will gradually become lower from the reset voltage, and will be eventually low enough to turn off the third transistor M3. After writing the data signal into the storage capacitor Cst, perform the emitting stage. During the emitting stage, the first control signal S1 will turn on the first transistor M1, the fifth control signal S5 will turn on the sixth transistor M6, the second control signal S2 will turn off the second transistor M2, the third control signal S3 will turn off the fourth transistor M4, and the fourth control signal S4 will turn off the fifth transistor M5 to make the LED D1 emit light according to the current flowing from the third transistor M3 to the LED D1. When the emitting stage is finished, perform the reset stage again, and repeat the aforementioned steps to the LED circuitry 200.

During the reset stage, when the first transistor M1 is turned on and the fourth transistor M4 is turned off, the fifth transistor M5 is turned on and the sixth transistor M6 is turned off first, and then the second transistor M2 is turned on. Besides, during the write stage, after resetting the storage capacitor Cst, the first transistor M1 is turned off first, and then the fourth transistor M4 is turned on. Further, during the emitting stage, after writing the data signal DATA into the storage capacitor Cst, the fourth transistor M4 is turned off first, and then the second transistor M2 is turned off, after that, the first transistor M1 and the sixth transistor M6 are turned on, and the fifth transistor M5 is turned off.

During the write stage, after writing the data signal DATA into the storage capacitor Cst, the voltage level stored in the storage capacitor Cst equals to ($V_{DATA}$+Vth−$V_{VREF}$). $V_{DATA}$ denotes the voltage level of the data signal DATA, Vth denotes the threshold voltage of a transistor, and $V_{VREF}$ denotes the voltage level of the reference voltage source VREF. Therefore, during the emitting stage, the voltage level stored in the storage capacitor Cst will definitely turn on the third transistor M3, so that the third transistor M3 can be operated under the saturation region, at this time, the current flowing from the third transistor M3 to the LED D1 is proportional to $(Vgs-Vth)^2$. Vgs denotes the gate-to-source voltage of a transistor. The gate-to-source voltage of the third transistor M3 equals to the difference between the voltage level of the second end of the third transistor M3 and the difference between the voltage level of the control end of the third transistor M3. Therefore, the gate-to-source voltage of the third transistor M3 is ($V_{DATA}$+Vth−$V_{VREF}$). Since the current flowing from the first end of the third transistor M3 to the second end of the third transistor M3 is proportional to $(Vgs-Vth)^2$, by replacing Vgs with ($V_{DATA}$+Vth−$V_{VREF}$), it can be derived that when the LED D1 is operated under the saturation region, the current flowing to the LED D1 is proportional to $(V_{DATA}-V_{VREF})^2$. It can be seen that the current flowing to the LED D1 will only change with the voltage level of the data signal DATA and the voltage level of the reference voltage source VREF, but will not change with the voltage level of the anode of the LED D1 or other variables, thus preventing from the prior art image retention problem due to the descending and instability of the current flowing to the LED D1. Besides, the service life of displays applying the first embodiment will be increased.

Figure 4:
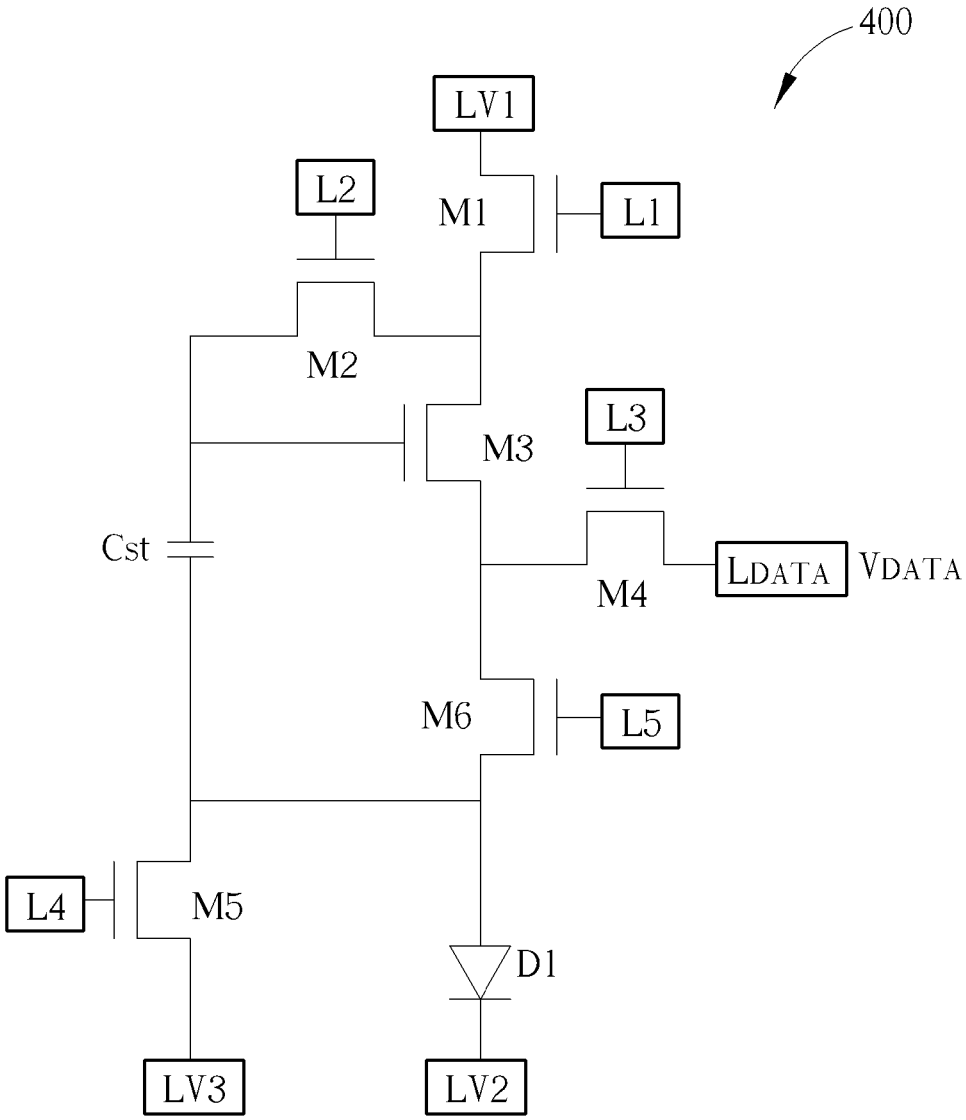
FIG. 4 shows an LED circuitry according to the second embodiment of the present invention.

Please refer to FIG. 4. FIG. 4 shows an LED circuitry 400 according to the second embodiment of the present invention. The light emitting diode circuitry 400 includes a first control signal trace L1, a second control signal trace L2, a third control signal trace L3, a fourth control signal trace L4, a fifth control signal trace L5, a first power trace LV1, a second power trace LV2, a reference voltage source trace LV3, a data signal trace $L_{DATA}$, a first transistor M1, a second transistor M2, a third transistor M3, a fourth transistor M4, a storage capacitor Cst, a fifth transistor M5, a sixth transistor M6 and a light emitting diode D1. The first transistor M1 has a control end electrically coupled to the first control signal trace L1, a first end for electrically coupling to the first power trace L1, and a second end. The second transistor M2 has a control end electrically coupled to the second control signal trace L2, a first end electrically coupled to the second end of the first transistor M1, and a second end. The third transistor M3 has a control end electrically coupled to the second end of the second transistor M2, a first end electrically coupled to the second end of the first transistor M1, and a second end. The fourth transistor M4 has a first end electrically coupled to the data signal trace $L_{DATA}$, a control end electrically coupled to the third control signal trace L3, and a second end electrically coupled to the second end of the third transistor M3. The storage capacitor Cst has a first end electrically coupled to the second end of the second transistor M2, and a second end. The fifth transistor M5 has a first end electrically coupled to the second end of the storage capacitor Cst, a control end electrically coupled to the fourth control signal trace L4, and a second end for electrically coupling to the reference voltage source trace LV3. The sixth transistor M6 has a first end electrically coupled to the second end of the fourth transistor M4, a control end electrically coupled to the fifth control signal trace L5, and a second end electrically coupled to the second end of the storage capacitor Cst. The light emitting diode D1 has a first end electrically coupled to the second end of the sixth transistor M6, and a second end for electrically coupling to the second power trace LV2. The first end of the light emitting diode D1 is an anode, and the second end of the light emitting diode D1 is a cathode. The light emitting diode D1 is used to emit light according to the voltage level of the second end of the sixth transistor M6. In the first embodiment, the first transistor M1, the second transistor M2, the third transistor M3, the fourth transistor M4, the fifth transistor M5 and the sixth transistor M6 can be N type metal oxide semiconductor transistor. However, the type of the first transistor M1, the second transistor M2, the third transistor M3, the fourth transistor M4, the fifth transistor M5 and the sixth transistor M6 is not limited, and can also be other types of transistors, e.g. field effect transistor, thin film transistor, bipolar junction transistor or thin film field effect transistor. The light emitting diode D1 can be an OLED. Besides, the voltage level of the first power source VDD is high, and the voltage level of the second power source VSS is low.

The difference between the second embodiment and the first embodiment is that the LED circuitry 400 further includes the first control signal trace L1, the second control signal trace L2, the third control signal trace L3, the fourth control signal trace L4, the fifth control signal trace L5, the first power trace LV1, the second power trace LV2, the reference voltage source trace LV3, and the data signal trace $L_{DATA}$. The first control signal trace L1, the second control signal trace L2, the third control signal trace L3, the fourth control signal trace L4, the fifth control signal trace L5, the first power trace LV1, the second power trace LV2, the reference voltage source trace LV3, the data signal trace $L_{DATA}$ are transmitting lines configured to transmit corresponding signals or powers. Besides, the first transistor M1 is electrically coupled to the first control signal trace L1, the second transistor M2 is electrically coupled to the second control signal trace L2, the fourth transistor M4 is electrically coupled to the data signal trace $L_{DATA}$, the fifth transistor M5 is electrically coupled to the fourth control signal trace L4, the sixth transistor M6 is electrically coupled to the fifth control signal trace L5, and the fifth transistor M5 is electrically coupled to the fourth control signal trace L4. Further, the first control signal trace L1, the second control signal trace L2, the third control signal trace L3, the fourth control signal trace L4, the fifth control signal trace L5, the data signal trace $L_{DATA}$, the first power trace LV1, the second power trace LV2 and the reference voltage source trace LV3 are used to provide the first control signal S1, the second control signal S2, the third control signal S3, the fourth control signal S4, the fifth control signal S5, the data signal DATA, the first power source VDD and the second power source VSS and the reference power source VREF, respectively. Similarly, the LED circuitry 400 can be operated according to the timing in FIG. 3. Therefore, when the LED D1 is operated under the saturation region, the current flowing to the LED D1 is $(V_{DATA}-V_{VREF})^2$. It can be seen that the current flowing to the LED D1 will only be affected by the voltage level of the data signal DATA and the voltage level of the reference voltage source VREF, but will not be affected by the voltage level of the anode of the LED D1, thus preventing from the prior art image retention problem due to the descending and instability of the current flowing to the LED D1. Besides, the service life of displays applying the first embodiment will be increased.

Figure 5:
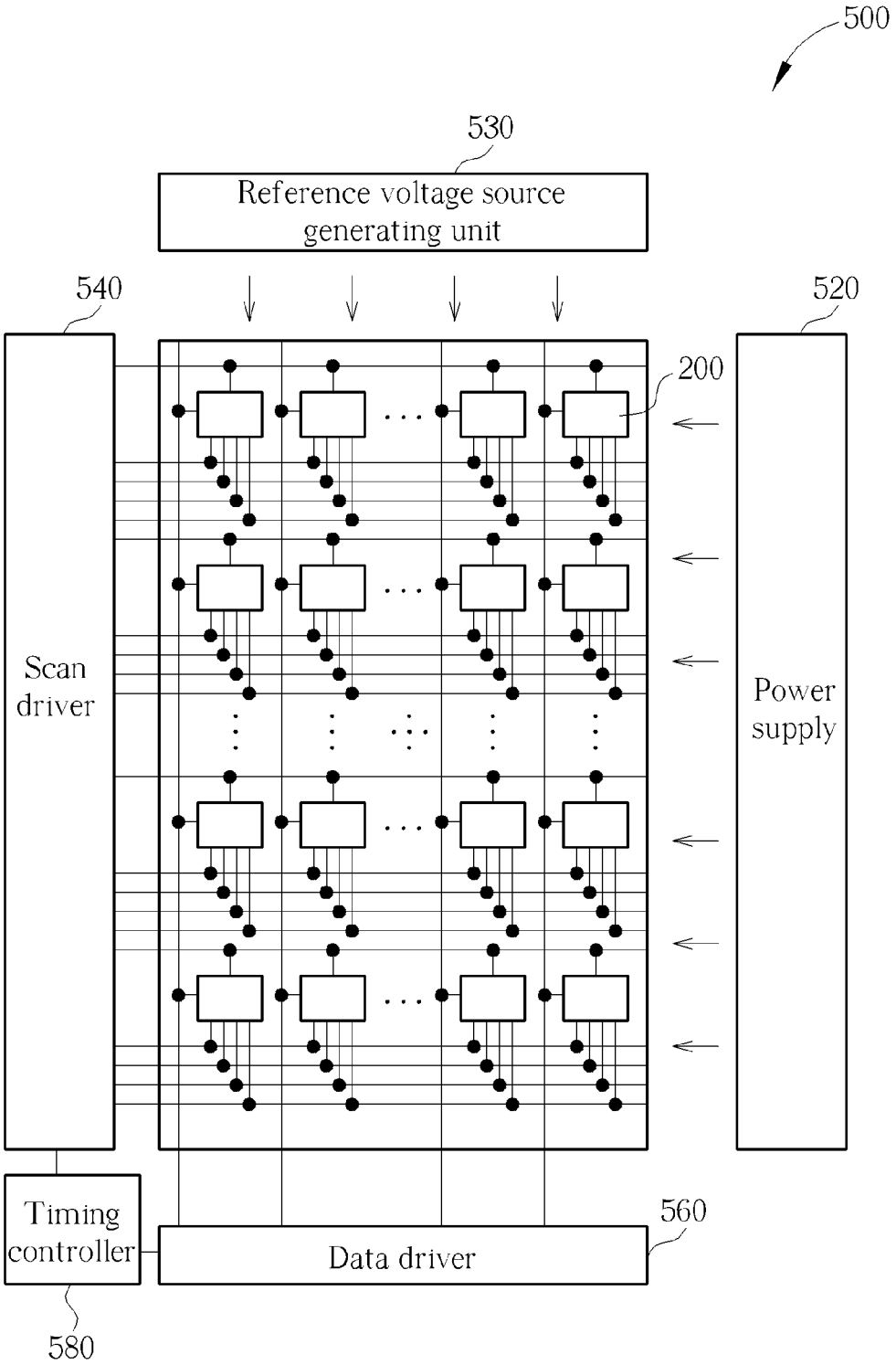
FIG. 5 shows a display according to the third embodiment of the present invention.

Please refer to FIG. 5 with FIG. 2 and FIG. 4. FIG. 5 shows a display 500 according to the third embodiment of the present invention. The display 500 includes a power supply 520, a reference voltage source generating unit 530, a scan driver 540, a data driver 560, a timing controller 580 and a plurality of light emitting diode circuitries 200. The power supply 520 is used for providing a first power source VDD and a second power source VSS (referring to FIG. 2), and the first power source VDD and the second power source VSS can be delivered by a first power trace and a second power trace (referring to the first power trace LV1 and the second power trace LV2 in FIG. 4). The reference voltage source generating unit 530 is used for providing a reference voltage source VREF, and the reference voltage source VREF can be delivered by a reference voltage source trace (referring to the reference voltage source trace LV3 in FIG. 4). The scan driver 540 is used for providing a first control signal S1, a second control signal S2, a third control signal S3, a fourth control signal S4 and a fifth control signal S5. The data driver 560 is used for providing a data signal DATA. The timing controller 580 is electrically coupled to the scan driver 540 and the data driver 560 for controlling the scan driver 540 and the data driver 560. The plurality of light emitting diode circuitries 200 are electrically coupled to the power supply 520, the reference voltage generating unit 530, the scan driver 540 and the data driver 560. Each light emitting diode circuitry 200 can be the as shown in FIG. 2 or FIG. 4. Each light emitting diode circuitry 200 includes a first transistor M1, a second transistor M2, a third transistor M3, a fourth transistor M4, a storage capacitor Cst, a fifth transistor M5, a sixth transistor M6 and a light emitting diode D1. Besides, for example, the power supply 520 and the reference voltage generating unit 530 can be digital-to-digital transformers, charge pump transformers or any known devices capable of generating digital voltage. The gate driver 540, the data driver 560 and the timing controller 580 can be application specific integrated circuits, field programmable gate arrays (FPGAs), CPUs or any known processing units capable of generating signals.

The LED circuitry 200 includes a first transistor M1, a second transistor M2, a third transistor M3, a fourth transistor M4, a storage capacitor Cst, a fifth transistor M5, a sixth transistor M6 and a light emitting diode D1. The first transistor M1 has a control end for receiving a first control signal S1, a first end for electrically coupling to a first power source VDD, and a second end. The second transistor M2 has a control end for receiving a second control signal S2, a first end electrically coupled to the second end of the first transistor M1, and a second end. The third transistor M3 has a control end electrically coupled to the second end of the second transistor M2, a first end electrically coupled to the second end of the first transistor M1, and a second end. The fourth transistor M4 has a first end for receiving a data signal DATA from a data source, a control end for receiving a third control signal S3, and a second end electrically coupled to the second end of the third transistor M3. The storage capacitor Cst has a first end electrically coupled to the second end of the second transistor M2, and a second end. The fifth transistor M5 has a first end electrically coupled to the second end of the storage capacitor Cst, a control end for receiving a fourth control signal S4, and a second end for electrically coupling to a reference voltage source VREF. The sixth transistor M6 has a first end electrically coupled to the second end of the fourth transistor M4, a control end for receiving a fifth control signal S5, and a second end electrically coupled to the second end of the storage capacitor Cst. The light emitting diode D1 has a first end electrically coupled to the second end of the sixth transistor M6, and a second end for electrically coupling to a second power source VSS. The first end of the light emitting diode D1 is an anode, and the second end of the light emitting diode D1 is a cathode. The light emitting diode D1 is used to emit light according to the voltage level of the second end of the sixth transistor M6. In the first embodiment, the first transistor M1, the second transistor M2, the third transistor M3, the fourth transistor M4, the fifth transistor M5 and the sixth transistor M6 can be N type metal oxide semiconductor transistor. However, the type of the first transistor M1, the second transistor M2, the third transistor M3, the fourth transistor M4, the fifth transistor M5 and the sixth transistor M6 is not limited, and can also be other types of transistors, e.g. field effect transistor, thin film transistor, bipolar junction transistor or thin film field effect transistor. Besides, the light emitting diode D1 can be an OLED.

The difference between the third embodiment and the first embodiment is that the display 500 further includes the power supply 520, the reference voltage source generating unit 530, the scan driver 540, the data driver 560 and the timing controller 580. The power supply 520, the reference voltage source generating unit 530, the scan driver 540, the data driver 560 and the timing controller 580 are electrically coupled to the LED circuitry 200 as described in the first embodiment. In the third embodiment, the LED circuitry 200 can be operated with steps described in the first embodiment according to the received first control signal S1, the second control signal S2, the third control signal S3, the fourth control signal S4 and the fifth control signal S5. Therefore, when the LED D1 is operated under the saturation region, the current flowing to the LED D1 is $(V_{DATA}-V_{VREF})^2$. It can be seen that in the present embodiment, the current flowing to the LED D1 will only be affected by the voltage level of the data signal DATA and the voltage level of the reference voltage source VREF, but will not be affected by the voltage level of the anode of the LED D1, thus preventing from the prior art image retention problem caused by descending and instability of the current flowing to the LED, and increasing the service life of displays applying the present embodiment.

In view of above, through utilizing the devices and methods in aforementioned embodiments, the image retention effect of displays can be reduced and the service life of displays can be greatly extended. Besides, the situation that the brightness of light emitting diodes is affected by the threshold voltage of transistor elements can be avoided.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode circuitry comprising:

a first transistor having a control end for receiving a first control signal, a first end for electrically coupling to a first power source, and a second end;

a second transistor having a control end for receiving a second control signal, a first end electrically coupled to the second end of the first transistor, and a second end;

a third transistor having a control end electrically coupled to the second end of the second transistor, a first end electrically coupled to the second end of the first transistor, and a second end;

a fourth transistor having a first end for receiving a data signal, a control end for receiving a third control signal, and a second end electrically coupled to the second end of the third transistor;

a storage capacitor having a first end electrically coupled to the second end of the second transistor, and a second end;

a fifth transistor having a first end electrically coupled to the second end of the storage capacitor, and a control end for receiving a fourth control signal, and a second end for electrically coupling to a reference voltage source;

a sixth transistor having a first end electrically coupled to the second end of the fourth transistor, a control end for receiving a fifth control signal, and a second end electrically coupled to the second end of the storage capacitor; and a light emitting diode having a first end electrically coupled to the second end of the sixth transistor, and a second end for electrically coupling to a second power source;

wherein the first end of the storage capacitor is configured to be discharged through the second transistor, the third transistor, and the fourth transistor according to the second control signal and the third control signal such that a voltage of the first end of the storage capacitor is lowered to turn off the third transistor.

2. The light emitting diode circuitry of claim 1, wherein the first, second, third, fourth, fifth and sixth transistors are thin film transistors.

3. The light emitting diode circuitry of claim 2, wherein the first end of the light emitting diode is an anode, and the second end of the light emitting diode is a cathode.

4. The light emitting diode circuitry of claim 1, wherein the first end of the light emitting diode is an anode, and the second end of the light emitting diode is a cathode.

5. The light emitting diode circuitry of claim 1, wherein the light emitting diode is an organic light emitting diode.

6. The light emitting diode circuitry of claim 1, wherein the first end of the first transistor is directly coupled to the first power source, the first end of the second transistor is directly coupled to the second end of the first transistor, the control end of the third transistor is directly coupled to the second end of the second transistor, the first end of the third transistor is directly coupled to the second end of the first transistor, the second end of the fourth transistor is directly coupled to the second end of the third transistor, the first end of the storage capacitor is directly coupled to the second end of the second transistor, the first end of the fifth transistor is directly coupled to the second end of the storage capacitor, the second end of the fifth transistor is directly coupling to the reference voltage source, the first end of the sixth transistor is directly coupled to the second end of the fourth transistor, a second end of the sixth transistor is directly coupled to the second end of the storage capacitor, the first end of the light emitting diode is directly coupled to the second end of the sixth transistor, and the second end of the light emitting diode is directly coupled to the second power source.

7. A light emitting diode circuitry comprising:

a first control signal trace;

a second control signal trace;

a third control signal trace;

a fourth control signal trace;

a fifth control signal trace;

a first power trace;

a second power trace;

a reference voltage source trace;

a data signal trace;

a first transistor having a control end electrically coupled to the first control signal trace, a first end for electrically coupling to the first power trace, and a second end;

a second transistor having a control end electrically coupled to the second control signal trace, a first end electrically coupled to the second end of the first transistor, and a second end;

a third transistor having a control end electrically coupled to the second end of the second transistor, a first end electrically coupled to the second end of the first transistor, and a second end;

a fourth transistor having a first end electrically coupled to the data signal trace, a control end electrically coupled to the third control signal trace, and a second end electrically coupled to the second end of the third transistor;

a storage capacitor having a first end electrically coupled to the second end of the second transistor, and a second end;

a fifth transistor having a first end electrically coupled to the second end of the storage capacitor, and a control end electrically coupled to the fourth control signal trace, and a second end for electrically coupling to the reference voltage source trace;

a sixth transistor having a first end electrically coupled to the second end of the fourth transistor, a control end electrically coupled to the fifth control signal trace, and a second end electrically coupled to the second end of the storage capacitor; and a light emitting diode having a first end electrically coupled to the second end of the sixth transistor, and a second end for electrically coupling to the second power trace;

wherein the first end of the storage capacitor is configured to be discharged through the second transistor, the third transistor, and the fourth transistor according to a control signal carried by the second control signal trace and a control signal carried by the third control signal trace such that a voltage of the first end of the storage capacitor is lowered to turn off the third transistor.

8. The light emitting diode circuitry of claim 7, wherein the first, second, third, fourth, fifth and sixth transistors are thin film transistors.

9. The light emitting diode circuitry of claim 8, wherein the first end of the light emitting diode is an anode, and the second end of the light emitting diode is a cathode.

10. The light emitting diode circuitry of claim 7, wherein the first end of the light emitting diode is an anode, and the second end of the light emitting diode is a cathode.

11. The light emitting diode circuitry of claim 7, wherein the control end of the first transistor is directly coupled to the first control signal trace, the first end of the first transistor is directly coupled to the first power trace, the control end of the second transistor is directly coupled to the second control signal trace, the first end of the second transistor is directly coupled to the second end of the first transistor, the control end of the third transistor is directly coupled to the second end of the second transistor, the first end of the third transistor is directly coupled to the second end of the first transistor, the first end of the fourth transistor is directly coupled to the data signal trace, the control end of the fourth transistor is directly coupled to the third control signal trace, the second end of the fourth transistor is directly coupled to the second end of the third transistor, the first end of the storage capacitor is directly coupled to the second end of the second transistor, the first end of the fifth transistor is directly coupled to the second end of the storage capacitor, the control end of the fifth transistor is directly coupled to the fourth control signal trace, the first end of the sixth transistor is directly coupled to the second end of the fourth transistor, the control end of the sixth transistor is directly coupled to the fifth control signal trace, the second end of the sixth transistor is directly coupled to the second end of the storage capacitor, and the first end of the light emitting diode is directly coupled to the second end of the sixth transistor.

12. The light emitting diode circuitry of claim 7, wherein the light emitting diode is an organic light emitting diode.

13. A method for driving a light emitting diode circuitry, the light emitting diode circuitry comprising a first transistor, a second transistor, a third transistor, a fourth transistor, a fifth transistor, a sixth transistor, a storage capacitor, and a light emitting diode, a first end of the first transistor being coupled to a first power source, a second end of the first transistor being electrically coupled to a first end of the second transistor and a first end of the third transistor, a second end of the second transistor being electrically coupled to a first end of the storage capacitor and a control end of the third transistor, a first end of the fourth transistor being electrically coupled to a data source, a second end of the third transistor being electrically coupled to a second end of the fourth transistor and a first end of the sixth transistor, a second end of the storage capacitor being electrically coupled to a second end of the sixth transistor and a first end of the fifth transistor, a second end of the fifth transistor being electrically coupled to a reference voltage source, the light emitting diode being electrically coupled to the second end of the sixth transistor and a second power source, the method comprising:

turning off the sixth transistor and turning on the second and fifth transistors when the first transistor is turned on and the fourth transistor is turned off, to refresh the storage capacitor;

turning off the first transistor and turning on the fourth transistor after refreshing the storage capacitor, to write a data signal inputted by the data signal trace to the storage capacitor; and turning on the first and sixth transistors and turning off the second, fourth and fifth transistors after writing the data signal to the storage capacitor, to turn on the light emitting diode according to the data signal;

wherein writing a data signal inputted by the data signal trace to the storage capacitor comprises discharging the first end of the storage capacitor through the second transistor, the third transistor, and the fourth transistor such that a voltage of the first end of the storage capacitor is lowered to turn off the third transistor.

14. The method of claim 13, wherein turning off the sixth transistor and turning on the second and fifth transistors when the first transistor is turned on and the fourth transistor is turned off comprises first turning on the fifth transistor and turning off the sixth transistor, and then turning on the second transistor when the first transistor is turned on and the fourth transistor is turned off.

15. The method of claim 14, wherein turning off the first transistor and turning on the fourth transistor after refreshing the storage capacitor comprises first turning off the first transistor, and then turning on the fourth transistor after refreshing the storage capacitor.

16. The method of claim 13, wherein turning on the first and sixth transistors and turning off the second, fourth and fifth transistors after writing the data signal to the storage capacitor comprises first turning off the fourth transistor, then turning off the second transistor, and finally turning on the first and sixth transistors and turning off the fifth transistor after writing the data signal to the storage capacitor.

17. The method of claim 13, wherein turning off the first transistor and turning on the fourth transistor after refreshing the storage capacitor comprises first turning off the first transistor, and then turning on the fourth transistor after refreshing the storage capacitor.

18. The method of claim 17, wherein turning on the first and sixth transistors and turning off the second, fourth and fifth transistors after writing the data signal to the storage capacitor comprises first turning off the fourth transistor, then turning off the second transistor, and finally turning on the first and sixth transistors and turning off the fifth transistor after writing the data signal to the storage capacitor.

19. The method of claim 13, wherein turning on the first and sixth transistors and turning off the second, fourth and fifth transistors after writing the data signal to the storage capacitor comprises first turning off the fourth transistor, then turning off the second transistor, and finally turning on the first and sixth transistors and turning off the fifth transistor after writing the data signal to the storage capacitor.

20. The method of claim 13, wherein the second end of the first transistor is directly coupled to the first end of the second transistor, the second end of the second transistor is directly coupled to the first end of the storage capacitor, the first end of the fourth transistor is directly coupled to the data source, the second end of the third transistor is directly coupled to the second end of the fourth transistor and the first end of the sixth transistor, the second end of the storage capacitor is directly coupled to the second end of the sixth transistor and the first end of the fifth transistor, the second end of the fifth transistor is directly coupled to the reference voltage source, and the light emitting diode is directly coupled to the second end of the sixth transistor and the second power source.

* * * * *